US007847777B2

(12) United States Patent
Choi

(10) Patent No.: US 7,847,777 B2
(45) Date of Patent: Dec. 7, 2010

(54) SOURCE DRIVER AND DISPLAY DEVICE HAVING THE SAME

(75) Inventor: Sung-Pil Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 790 days.

(21) Appl. No.: 11/561,223

(22) Filed: Nov. 17, 2006

(65) Prior Publication Data

US 2007/0182667 A1 Aug. 9, 2007

(30) Foreign Application Priority Data

Feb. 3, 2006 (KR) ..... 10-2006-0010858

(51) Int. Cl.
*G09G 3/36* (2006.01)

(52) U.S. Cl. ..... 345/98; 345/55

(58) Field of Classification Search ..... None
See application file for complete search history.

(56) References Cited

U.S. PATENT DOCUMENTS 6,697,041 B1 * 2/2004 Tamai et al. ..... 345/100
7,403,185 B2 * 7/2008 Song et al. ..... 345/100
2002/0080107 A1 6/2002 Fujimoto et al.

FOREIGN PATENT DOCUMENTS

| | | |
|---|---|---|
| JP | 2002-91404 | 3/2002 |
| KR | 2001-0109217 | 12/2001 |
| KR | 1020030070265 A | 8/2003 |
| KR | 10-2005-0002428 A | 1/2005 |

* cited by examiner

*Primary Examiner*—Alexander Eisen
*Assistant Examiner*—Robin Mishler
(74) *Attorney, Agent, or Firm*—F. Chau & Associates, LLC

(57) ABSTRACT

A source driver and a display device having the same, in which the source driver performs charge sharing on source line driving signals in synchronization with an odd-numbered rising edge of the first output control signal, and outputs analog data signals to source lines of a display panel in synchronization with an even-numbered rising edge of the first output control signal, thereby removing scan line noise.

9 Claims, 10 Drawing Sheets

SOURCE DRIVER AND DISPLAY DEVICE HAVING THE SAME

CROSS-REFERENCE TO RELATED PATENT APPLICATION

This application claims priority under 35 U.S.C. #119 from Korean Patent Application No. 10-2006-0010858, filed on Feb. 3, 2006, the disclosure of which is hereby incorporated by reference herein as if set forth in its entirety.

BACKGROUND OF THE INVENTION

1. Technical Field

The present disclosure relates to a display device, and more particularly, to a source driver capable of removing scan line noise and a display device having the same.

2. Discussion of the Related Art

FIG. 1 is a block diagram of a conventional display device 100. The display device 100 includes a display panel 110 having liquid crystal cells 111 that are arranged in the form of a matrix where gate lines G1 through GQ intersect source lines Y1 through YP; a gate drive 120 that drives the gate lines G1 through GQ; and a source driver 130 that drives source lines Y1 through YP. Each of the liquid crystal cells 111 includes a switch 112 connected to a corresponding gate line and a corresponding source line, and a liquid crystal (not shown).

The display device 100 uses a sequential line driving method in which an image is displayed by sequentially driving the gate lines G1 through GQ. When the gate driver 120 supplies a driving signal to one of the gate lines G1 through GQ, all switches (not shown) connected to the gate line are turned on. Signals transmitted from the source driver 130 to the source lines Y1 through YP are supplied to a pixel electrode VPIX corresponding to the switch turned on by the gate driver 120 via the switches.

The supply of the signals to the pixel electrode VPIX causes an electric field to occur between the pixel electrode VPIX and a common electrode VCOM, and the electric field changes the orientation of the liquid crystal in the corresponding liquid crystal cell 111, thus displaying an image. The crystal cell 111 further includes a storage capacitor CST to maintain a signal supplied to the pixel electrode VPIX until a gate line is driven for a next frame. There is also some capacitance associated with the liquid crystal.

If an electric field is maintained in a liquid crystal cell, which is controlled by an electric field, in the same direction, the liquid crystal in the liquid crystal cell is degraded, thus causing performance degradation. Accordingly, a polarity of a pixel electrode with respect to a common electrode must be inverted at predetermined intervals of time so as to change the direction of the electric field applied to the liquid crystal cell.

Therefore, a frame inversion method, a line inversion method, a column inversion method, and a dot inversion method have been introduced. In the case of the frame inversion method in which the direction of an electric field is changed for each frame, however, the electric field is maintained in the same direction until a frame is scanned, and thus, a leakage current is generated from a switch, thus lowering a level of a signal to be supplied to a liquid crystal cell.

In the line inversion method, pixels have the same polarity in a horizontal direction, thus causing cross talk in the horizontal direction. In the column inversion method, cross talk is present in the vertical direction, and a high-voltage source driver is needed to respectively supply signals having different polarities to adjacent source lines.

In the dot inversion method, since all adjacent pixels have different polarities, the cross talk can be solved and the image quality improved, but a high-voltage source driver is needed and power consumption is increased.

A multi-line inversion method or a multi-dot inversion method has been introduced to solve these problems. The multi-inversion method includes a 2H-inversion method in which signal polarity is changed every two horizontal periods, wherein the horizontal period indicates a period during which a gate line is driven.

FIGS. 2A and 2B are waveform diagrams of source line driving signals SIC_ODD and SIC_EVEN, a gate line driving signal GIC, a common electrode signal VCOM, and a first output control signal CLK1 in a conventional display device that is driven by a sub-dot pattern. The first output control signal CLK1 is also referred to as a load signal or a data latch signal according to source driver manufacturing companies.

Referring to FIGS. 2A and 2B, during an odd-numbered active (high-level) period of the first output control signal CLK1, a charge sharing operation C/S is performed to equalize the voltage of the odd-numbered source line driving signal SIC_ODD with that of the even-numbered source line driving signal SIC_EVEN. The source driver is maintained at a high-impedance state H1_Z during an even-numbered active period of the first output control signal CLK1.

The source line driving signals SIC_ODD and SIC_EVEN are supplied to source lines in response to a falling edge of the first output control signal CLK1.

When the two source line driving signals SIC_ODD and SIC_EVEN are output in an even-numbered horizontal (2H) period, voltage levels are changed in the same direction, thus causing common voltage noise NOISE. Further, the source line driving signals SIC_ODD and SIC_EVEN coupled to common voltage VCOM are affected by the common voltage noise NOISE.

As illustrated in FIG. 2A, there are no problems when a common voltage noise NOISE is low. As illustrated in FIG. 2B, however, when a common voltage noise NOISE is increased due to an external compensation circuit or the arrangement of power lines in a panel, the source line driving signals SIC_ODD and SIC_EVEN are coupled to the common voltage noise NOISE. Thus, the levels of the source line driving signals SIC_ODD and SIC_EVEN do not reach a saturation state until a gate line driving signal (GIC) 203 is supplied in the 2H period after inversion.

Accordingly, the different between an (A) region charged by supplying a gate line driving signal 201 in an 1H period, and a (B) region charged by supplying the gate line driving signal (GIC) 203 in the 2H period while the levels of the source line driving signals SIC_ODD and SIC_EVEN do not reach the saturation state, is caused. That is, the difference between the charging rates of the two consecutive gate line driving signals (GIC) 201 and 203 is caused. In this case, scan line noise, that is, a wave pattern in which a dark line and a light line alternately recur, is generated.

SUMMARY OF THE INVENTION

Exemplary embodiments of the present invention provide a source driver capable of substantially removing scan line noise, and a display device having the same.

According to an exemplary embodiment of the present invention, there is provided a display device including a controller generating a vertical start signal, output control signals, and digital image data; a display panel having a plurality of source lines and a plurality of gate lines; a source driver supplying analog data signals corresponding to the digital image data to the source lines in response to the output control signals and the digital image data; and a gate driver generating gate line driving signals for sequentially driving the gate lines in response to the vertical start signal. The source driver performs a charge sharing operation for the source lines during an odd-numbered active period of a first output control signal among the output control signals, and supplies the analog data signals to the source lines at an even-numbered rising edge of the first output control signal.

According to an exemplary embodiment of the present invention, there is provided a method of driving a display device, the method including generating output control signals and digital image data; supplying analog data signals corresponding to the digital image data to a plurality of source lines of a display panel, in response to the output control signals and the digital image data; and performing a charging sharing operation for the source lines during an odd-numbered active period of a first output control signal among the output control signals, and supplying the analog data signals to the source lines at an even-numbered rising edge of the first output control signal.

BRIEF DESCRIPTION OF THE DRAWINGS

Exemplary embodiments of the present invention will be understood in more detail from the following descriptions taken in conjunction with the accompanying drawings in which.

DETAILED DESCRIPTION OF EXEMPLARY EMBODIMENTS

Figure 1:
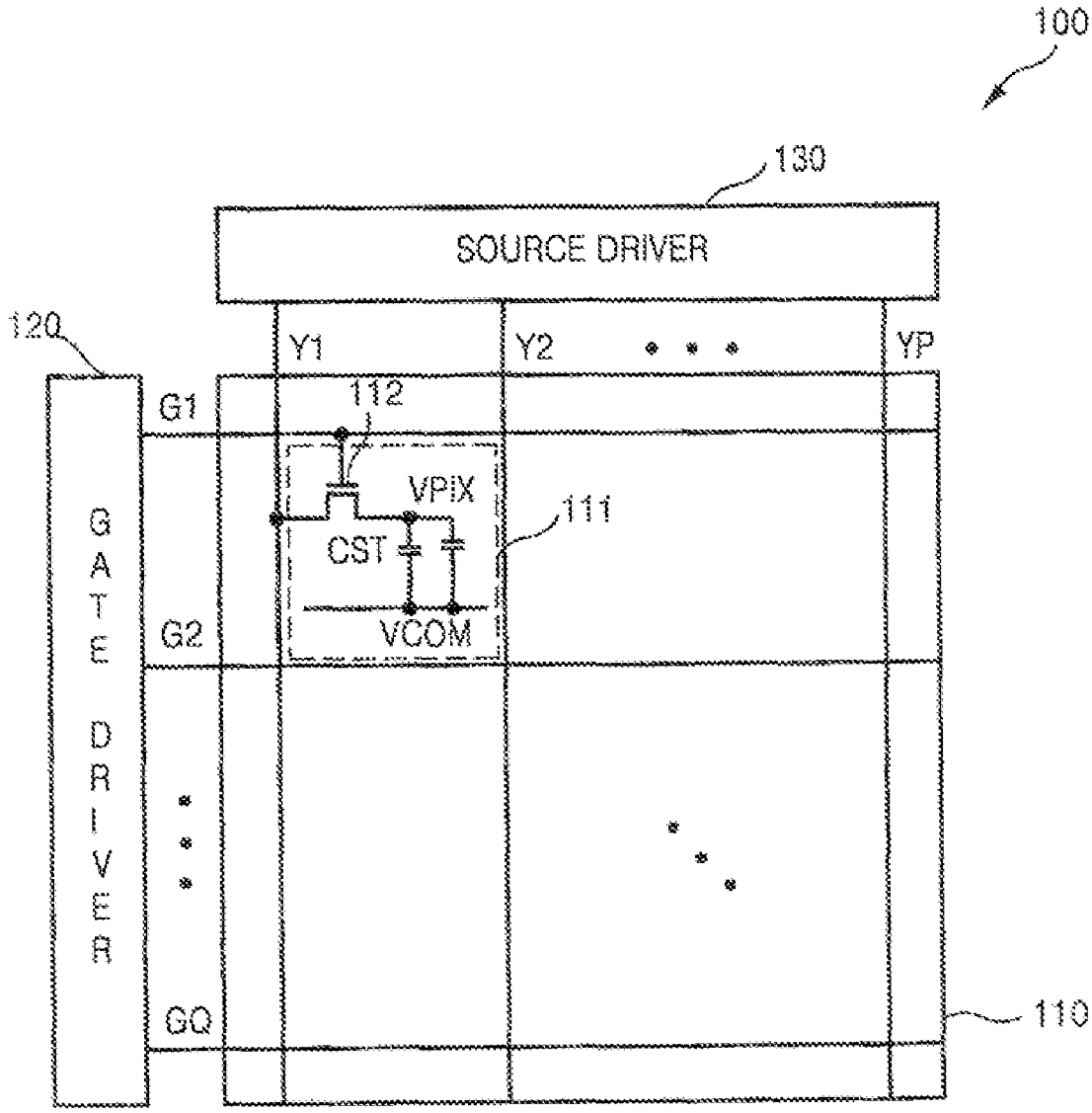
FIG. 1 (CONVENTIONAL ART)
FIG. 1 is a block diagram of a conventional display device.
Figure 2A:
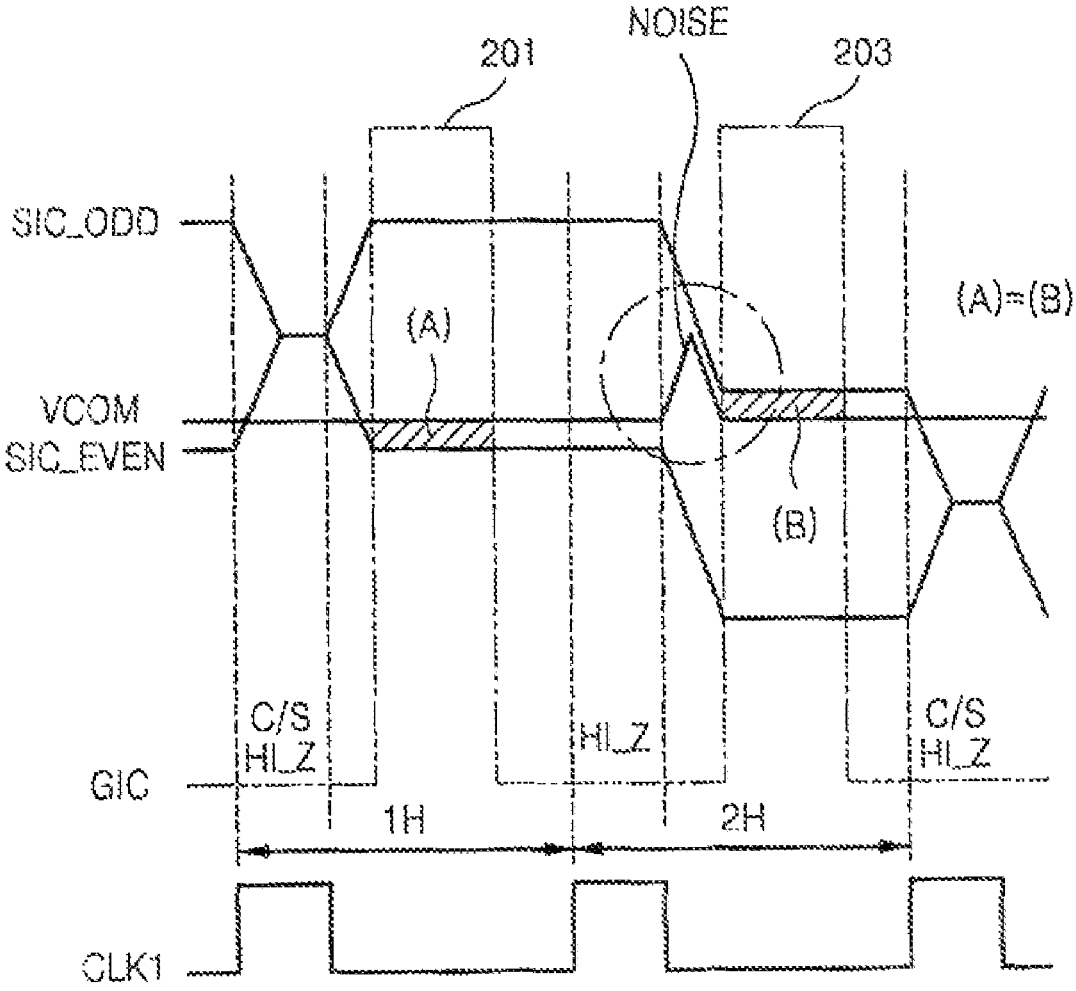
FIG. 2A (CONVENTIONAL ART)
FIG. 2A is a waveform diagram of signals in a conventional display device driven by a 2H-inversion sub dot pattern, when the common voltage noise is low.
Figure 2B:
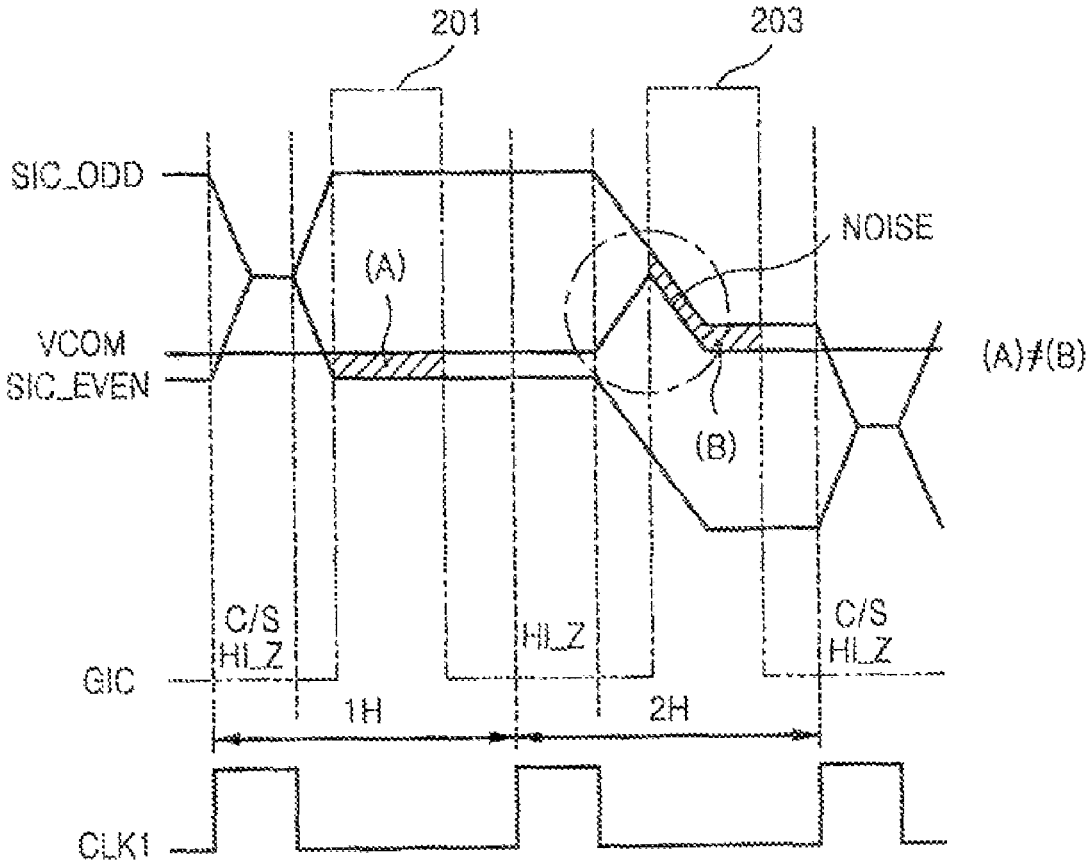
FIG. 2B (CONVENTIONAL ART)
FIG. 2B is a waveform diagram of signals in a conventional display device driven by the 2H-inversion sub dot pattern, when the common voltage noise is high.
Figure 3:
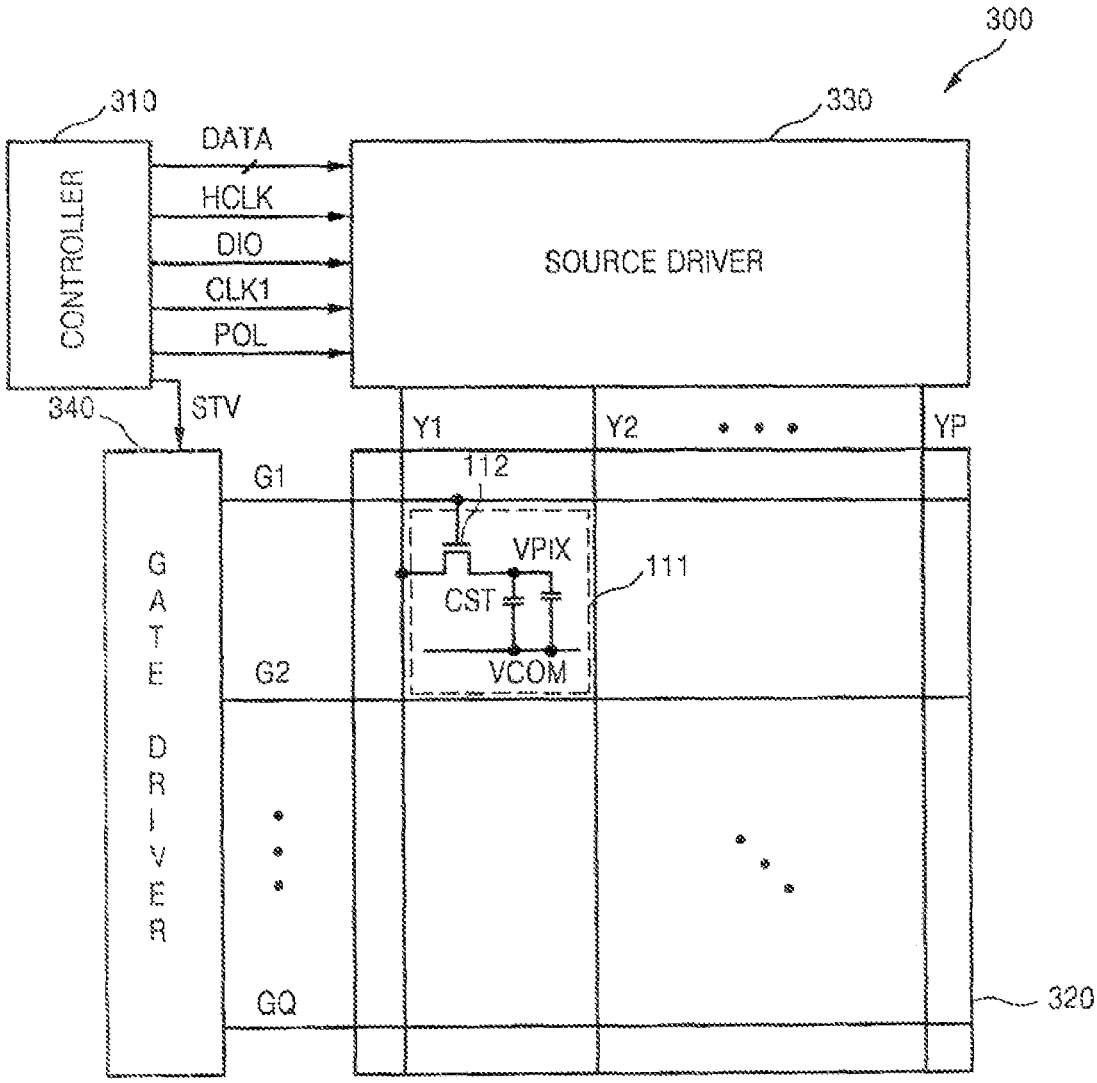
FIG. 3 is a functional block diagram of a display device according to an exemplary embodiment of the present invention.

FIG. 3 is a functional block diagram of a display device 300 according to an exemplary embodiment of the present invention. The display device 300 is a flat panel display, such as a thin film transistor (TFT)-liquid crystal display (LCD), and organic light-emitting diode (OLED), and a plasma display panel (PDP).

Referring to FIG. 3, the display device 300 includes a controller 310, a display panel 320, a source driver (or a data line driver) 330, and a gate driver (or a scan line driver) 340. The controller 310 generates a vertical start signal STV, output control signals HCLK, DIO, CLK1, and POL, and digital image data DATA.

In the display panel 320, a plurality of source lines Y1 through YP intersect a plurality of gate lines G1 through GQ in the form of a matrix, and a plurality of liquid crystal cells 111 are arranged where the source lines Y1 through YP intersect the gate lines G1 through GQ, respectively. Each of the liquid crystal cells 111 includes a switch 112 connected to a corresponding source line and gate line, and a liquid crystal (not shown).

The source driver 330 performs a charge sharing operation for the source lines Y1 through YP during an odd-numbered active period of the first output control signal CLK1 among the plurality of output control signals HCLK, DIO, CLK1, and POL, and supplies analog data signals corresponding to the digital image data DATA to the source lines Y1 through YP in response to an even-numbered rising edge of the first output control signal CLK1. The gate driver 340 generates gate line driving signals for sequentially driving the plurality of gate lines G1 through GQ in response to the vertical start signal STV.

When switches (not shown) coupled to the gate lines G1 through GQ that are sequentially driven in response to the gate line driving signals are turned on, the analog data signals supplied to the source line Y1 through YP are supplied to corresponding pixel electrodes VPIX via the turned-on switches, respectively.

Thus, an electric field generated between the pixel electrode VPIX and a common electrode VCOM changes the orientation of the liquid crystal in the corresponding liquid crystal cell 111, thus displaying an image. The liquid crystal cell 111 further includes a storage capacitor CST that maintains the analog data signal supplied to the pixel electrode VPIX until the gate line is driven for a next frame.

Figure 4:
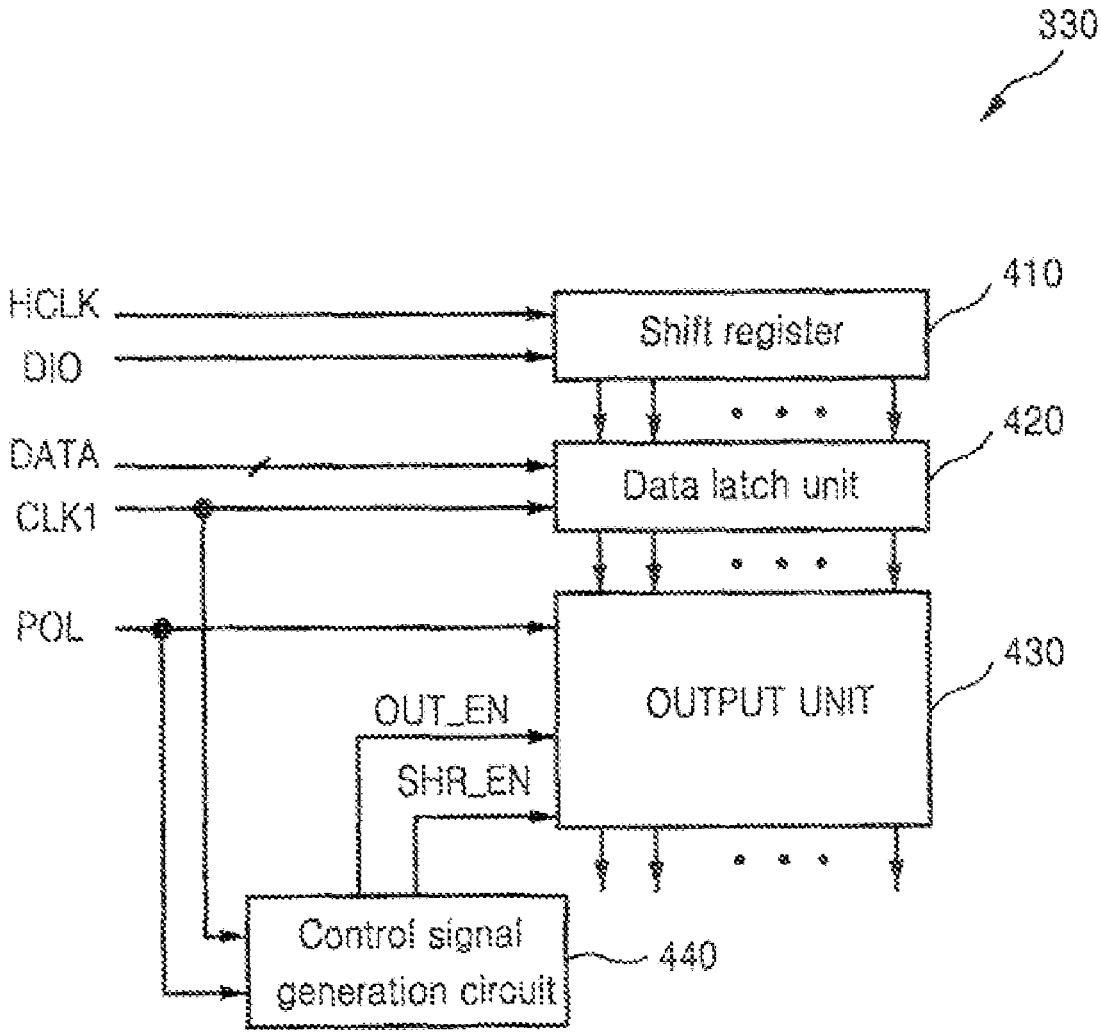
FIG. 4 is a block diagram of a source driver illustrated in FIG. 3 according to an exemplary embodiment of the present invention.

FIG. 4 is a functional block diagram of the source driver 330 illustrated in FIG. 3 according to an exemplary embodiment of the present invention. Referring to FIG. 4, the source driver 330 includes a shift register 410, a data latch unit 420, an output unit 430, and a control signal generation circuit 440.

The shift register 410 includes a plurality of latches (not shown) that sequentially shift a horizontal start signal DIO in response to a clock signal HCLK.

The data latch unit 420 receives and stores the digital image data DATA in response to the shifted horizontal start signal DIO, and outputs the stored digital image data DATA in response to a rising edge of the first output control signal CLK1.

The output unit 430 receives the digital image data DATA from the data latch unit 420, and supplies analog data signals corresponding to the received digital image data DATA to the display panel 320, in response to a polarity control signal POL and an activated second output control signal OUT_EN, which is at a logic high level, for example.

The control signal generation circuit 440 generates the second output control signal OUT_EN and a third output control signal SHR_EN in response to the first output control signal CLK1 and the polarity control signal POL. The polarity control signal POL controls the polarities of the analog data signals to be supplied to the display panel 320.

Figure 5:
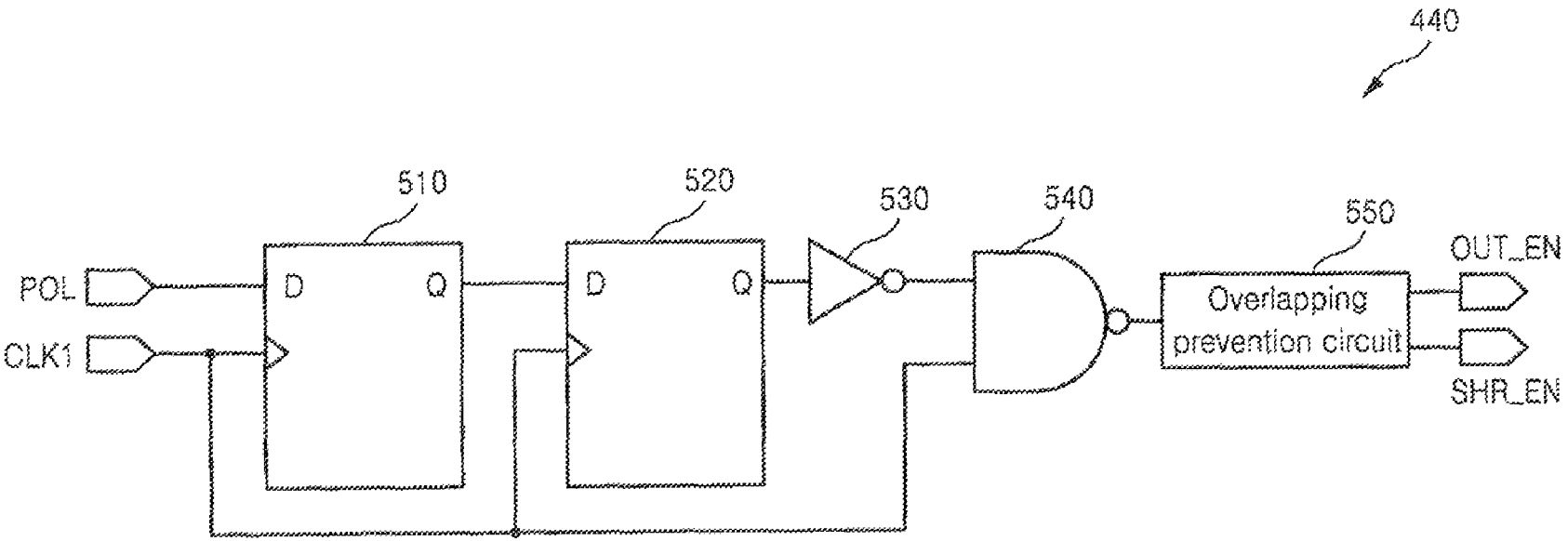
FIG. 5 is a circuit diagram of a control signal generation circuit illustrated in FIG. 4 according to an exemplary embodiment of the present invention.

FIG. 5 is a circuit diagram of the control signal generation circuit 440 illustrated in FIG. 4 according to an exemplary embodiment of the present invention. Referring to FIG. 5, the control signal generation circuit 440 includes a first latch (or a first D flip-flop) 510, a second latch (or a second D flip-flop) 520, an inverter 530, a NAND gate 540, and an overlapping prevention circuit 550.

The first latch (or first D flip-flop) 510 latches the polarity control signal POL in response to the first output control signal CLK1. The second latch (or second D flip-flop) 520 latches a signal output from an output terminal of the first latch (or first D flip-flop) 510 in response to the first output control signal CLK1. The inverter 530 is connected to an output terminal of the second latch (or second D flip-flop) 520, and the NAND gate 540 receives the first output control signal CLK1 and a signal from an output terminal of the inverter 530, and performs a NAND operation thereon.

Figure 7A:
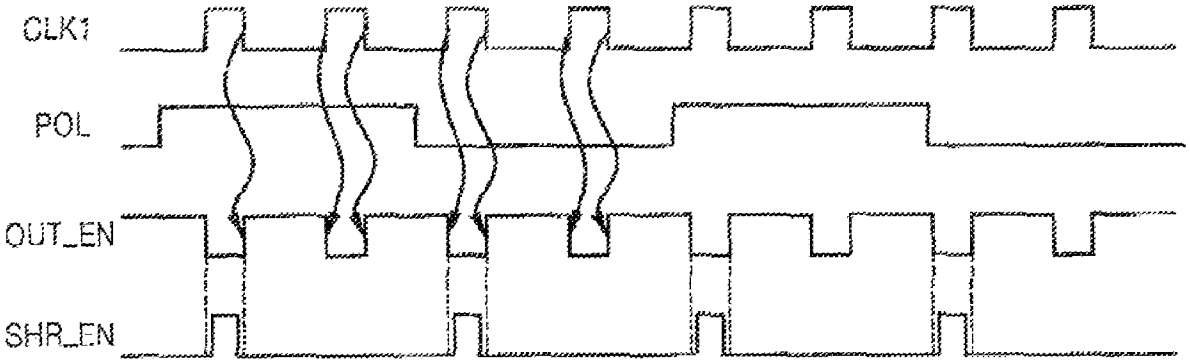
FIG. 7A is a timing diagram of output control signals in a conventional display device driven according to a 2H-inversion method.
Figure 7B:
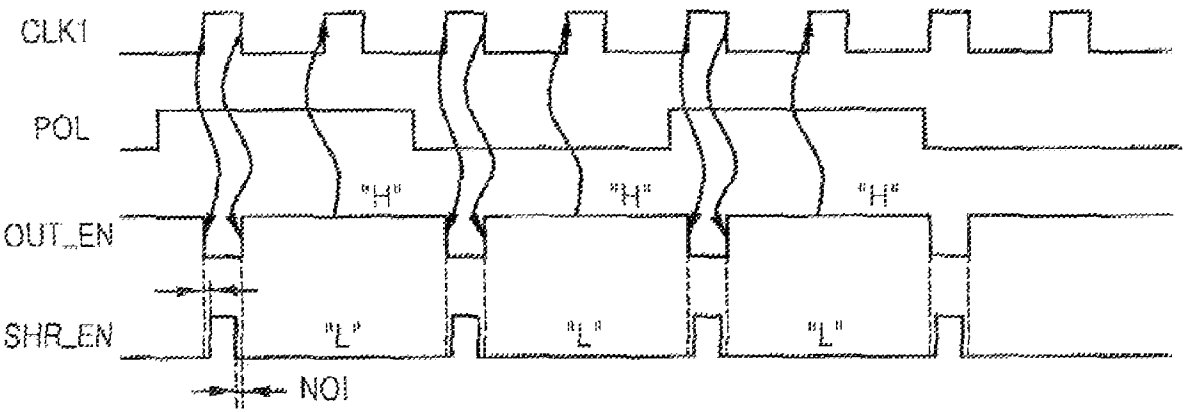
FIG. 7B is a timing diagram of signals supplied to and output from the control signal generation circuit illustrated in FIG. 4, according to an exemplary embodiment of the present invention.

The overlapping prevention circuit 550 receives a signal from the NAND gate 540, and generates a second output control signal OUT_EN and a third output control signal SHR_EN that have a predetermined non-overlapped region NOI and the opposite phases except in the non-overlapped region NOI, as illustrated in FIG. 7B.

Figure 6:
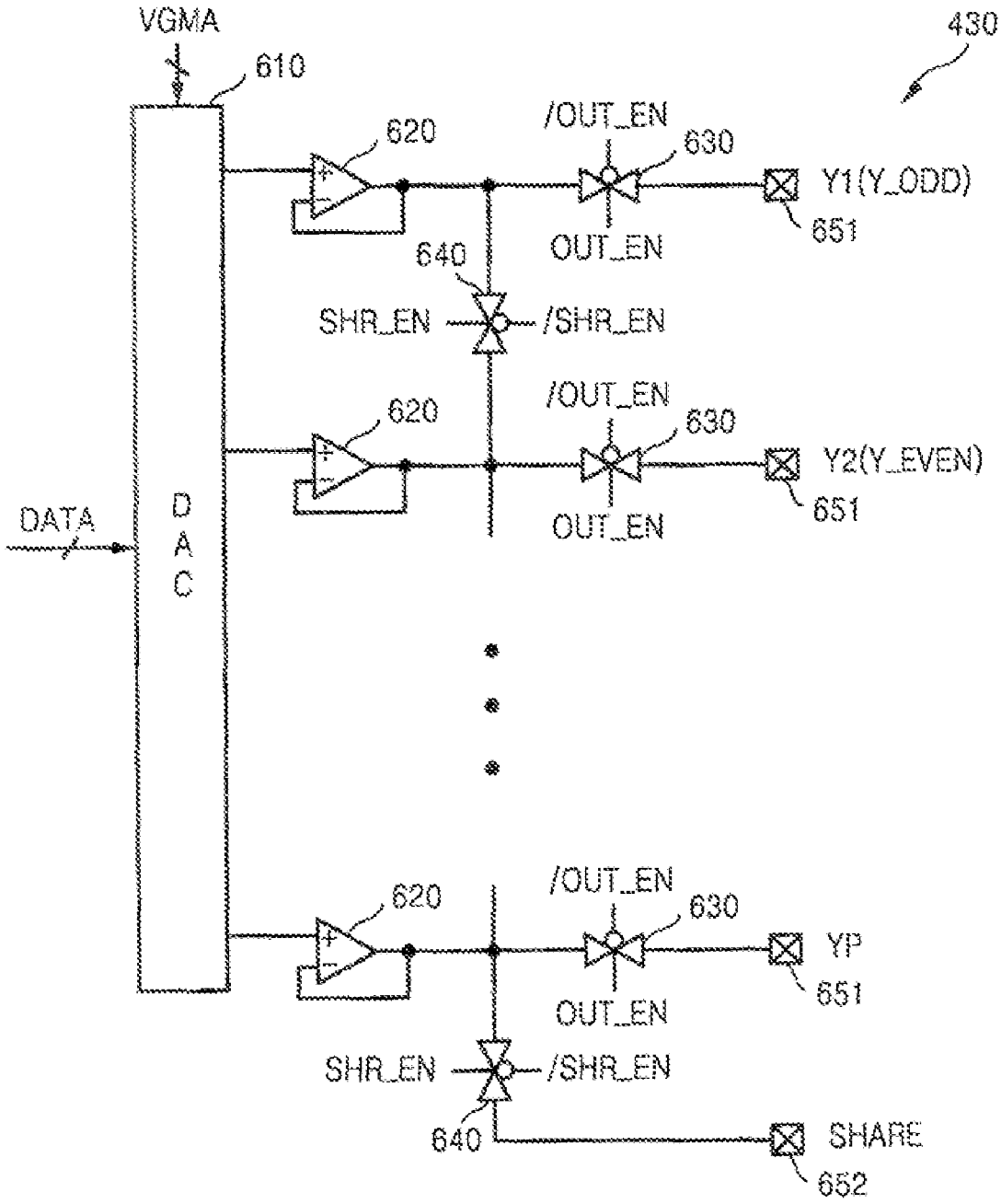
FIG. 6 is a circuit diagram of an output illustrated in FIG. 4 according to an exemplary embodiment of the present invention.

FIG. 6 is a circuit diagram of the output unit 430 illustrated in FIG. 4 according to an exemplary embodiment of the present invention. Referring to FIG. 6, the output unit 430 includes a digital-to-analog converter (DAC) 610, a plurality of output buffers 620, a plurality of first switches 630, a plurality of second switches 640, a plurality of output pads 651, and a pad 652.

The DAC 610 generates analog data signals corresponding to the digital image data DATA output from the data latch unit 420 of FIG. 4, in response to gray scale voltages VGMA.

The output buffers 620 respectively buffer corresponding analog data signals from the DAC 610. Each of the output buffers 620 may be implemented as a unit gain buffer or an operational amplifier, but is not limited thereto.

The output pads 651 are connected to the corresponding source lines Y1 through YP of the display device 300 illustrated in FIG. 3, respectively. The output pad 652 is an open pad for the charge sharing operation of the source lines Y1 through YP.

Each of the first switches 630 is connected between a corresponding output of one of the output buffers 620 and a corresponding one of the output pads 651, and is switched on in response to the second output control signal OUT_EN. Each of the first switches 630 may be embodied as a transmission gate, but is not limited thereto.

Each of the second switches 640 is connected between the output terminals of corresponding two output buffers of the output buffers 620, and switched on in response to the third output control signal SHR_EN. Each of the second switches 640 may be embodied as a transmission gate, but is not limited thereto. Referring to FIGS. 6 and 7B, the first switches 630 and the second switches 640 are respectively complementarily turned on/off.

FIG. 7A is a timing diagram of a first output control signal CLK1, a polarity control signal POL, a second output control signal OUT_EN, and a third output control signal SHR_EN in a conventional display device driven according to the 2H-inversion method in which the phase of the polarity control signal POL is inverted every two pulse cycles of the first output control signal CLK1.

FIG. 7B is a timing diagram of a second output control signal OUT_EN and a third output control signal SHR_EN generated by the control signal generation circuit 440, based on the polarity control signal POL and the first output control signal CLK1 in the display device 300 driven according to the 2H-inversion method, according to an exemplary embodiment of the present invention.

Referring to 7A, the second output control signal OUT_EN in the conventional display device is activated (goes high, for example) in response to an $N^{th}$ falling edge of the first output control signal CLK1 and deactivated (goes low, for example) in response to an $(N+1)^{th}$ rising edge of the first output control signal CLK1 (N is an odd number). In contrast, referring to FIG. 7B, the second output control signal OUT_EN output from the control signal generation circuit 440, according to an exemplary embodiment of the present invention, is activated in response to an $N^{th}$ falling edge of the first output control signal CLK1 and deactivated in response to an $(N+2)^{th}$ rising edge of the first output control signal CLK1 (N is an odd number).

That is, in the conventional display device, the conventional display device outputs analog data in response to an $(N+1)^{th}$ falling edge of the first output control signal CLK1. The second output control signal OUT_EN generated by the control signal generation circuit 440 of the source driver 330, according to an exemplary embodiment of the present invention, however, is maintained in the activate state at the $(N+1)^{th}$ rising edge of the first output control signal CLK1. Thus, the source driver 330 having the control signal generation circuit 440 can output analog data signals to the source lines Y1 through YP in synchronization with the $(N+1)^{th}$ rising edge of the first output control signal CLK1.

Also, the third output control signal SHR_EN generated by the control signal generation circuit 440 is deactivated in response to the $N^{th}$ falling edge of the first output control signal CLK1 and then activated at the $(N+2)^{th}$ rising edge of the first output control signal CLK1 (N is an odd number).

Figure 8:
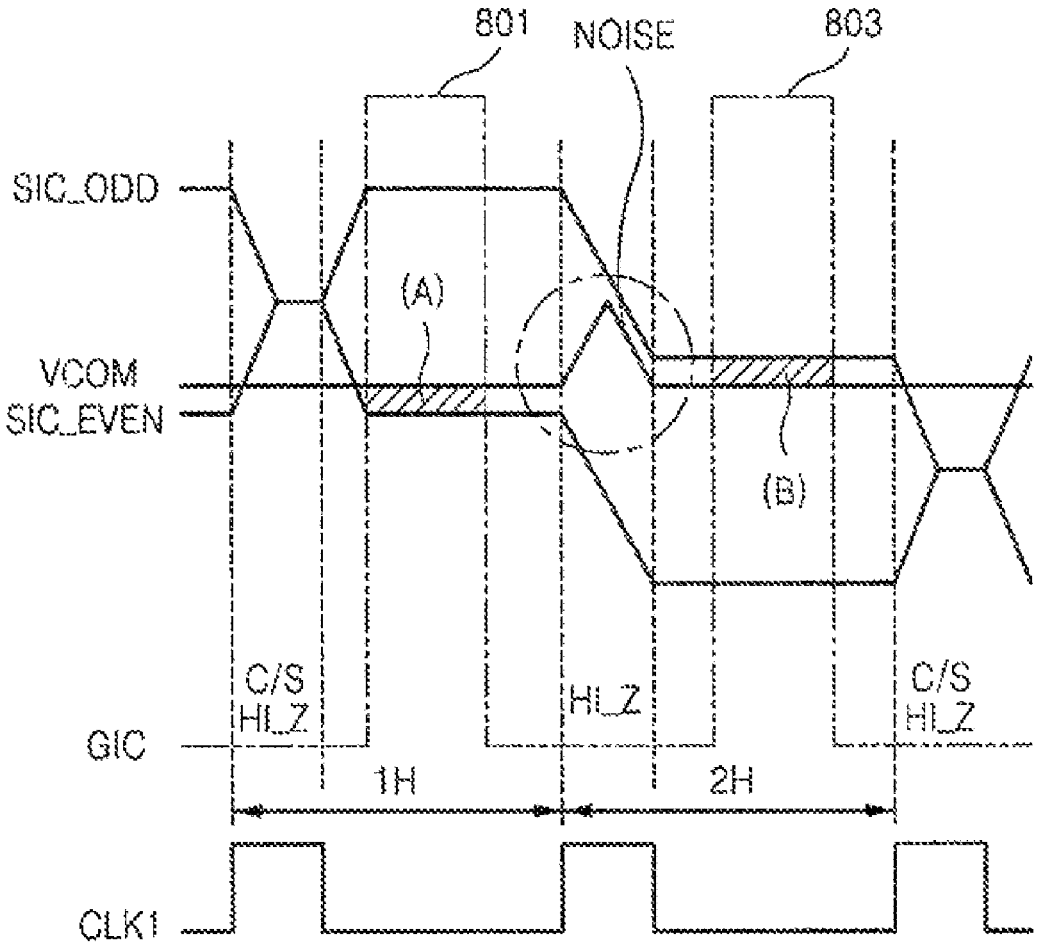
FIG. 8 is a timing diagram of signals in a display device driven by a 2H-inversion sub dot pattern, according to an exemplary embodiment of the present invention.

FIG. 8 is a timing diagram of source line driving signals SIC_ODD and SIC_EVEN, a gate line driving signal GIC, a common electrode signal VCOM, and a first output control signal CLK1 in the display device 300 driven according to the sub dot pattern included in the 2H-inversion method, according to an exemplary embodiment of the present invention.

Referring to FIGS. 3 through 6, 7B and 8, the odd-numbered source line driving signal SIC_ODD and the even-numbered source line driving signal SIC_EVEN are charge-shared (C/S) during a first active period of the first output control signal CLK1. The second output control signal OUT_EN is maintained in the activate state (for example, high) from a first falling edge of the first output control signal CLK1 to a third rising edge thereof. Thus, the source line driving signals SIC_ODD and SIC_EVEN are supplied to the source lines Y1 through YP in synchronization with a second rising edge of the first output control signal CLK1.

Accordingly, the phases of the source line driving signals SIC_ODD and SIC_EVEN are inverted regardless of a level of common voltage noise NOISE, and reach a saturation sate before a gate line driving signal (GIC) 803 is supplied in the 2H period. Thus, the charging rate (A) of a 1H region charged by the gate line driving signal (GIC) 801 is substantially the same as the charging rate (B) of the 2H region charged by the gate line driving signal (GIC) 803.

Figure 9:
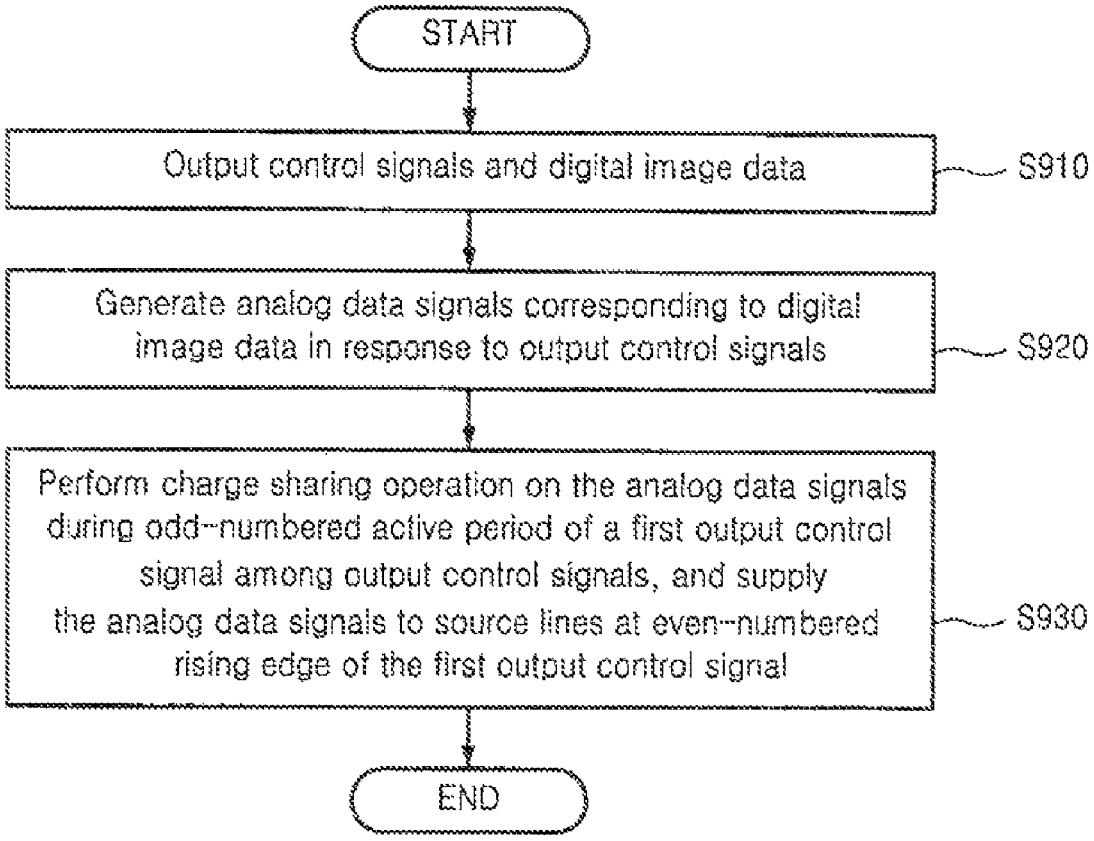
FIG. 9 is a flowchart illustrating a method of driving a display device according to an exemplary embodiment of the present invention.

FIG. 9 is a flowchart illustrating a method of driving a display device according to an exemplary embodiment of the present invention. Referring to FIGS. 3 and 9, the controller 310 supplies the output control signals HCLK, DIO, CLK1, and POL, and the digital image data DATA to the source driver 330 (S910). The source driver 330 generates analog data signals corresponding to the received digital image data DATA in response to the received output control signals HCLK, DIO, CLK1, and POL (S920).

The source driver 330 performs the charge sharing operation on the analog data signals during an odd-numbered active period of the first output control signal CLK1 among the received output control signals HCLK, DIO, CLK1, and POL, and supplies the analog data signals to the source lines Y1 through YP in response to an even-numbered rising edge of the first output control signal CLK1 (S930). Therefore, scan line noise is substantially reduced.

As described above, in a source driver, a display device having the same, and a method of driving the display device according to an exemplary embodiment of the present invention, the level of a desired source line driving signal reaches a saturation state before a gate line driving signal is supplied, thereby removing streak phenomenon in which a dark line and a light line alternately recur, that is, scan line noise.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A source driver of a display device comprising:

a data latch unit receiving and storing digital image data in response to a horizontal start signal, and outputting the stored digital image data in response to a rising edge of a first output control signal, wherein the horizontal start signal is sequentially shifted in response to a clock signal;

an output unit receiving the digital image data from the data latch unit, and supplying analog data signals corresponding to the received digital image data to a display panel in response to a polarity control signal and an activated second output control signal; and a control signal generation circuit generating the second output control signal that is activated in response to an $N^{th}$ falling edge of the first output control signal and deactivated in response to an $(N+2)^{th}$ rising edge of the first output control signal, in response to the first output control signal and the polarity control signal which controls polarities of the analog data signal supplied to the display panel, where N is an odd number, and wherein the second output control signal has a first level and a second level, the first level is higher than the second level, and the control signal generation circuit maintains the second output control signal at the first level at the $(N+1)^{th}$ rising edge of the first output control signal.

2. The source driver of claim 1, wherein the output unit comprises:

a digital-to-analog converter generating the analog data signal corresponding to the received digital image data;

a plurality of output buffers, each buffering a corresponding analog data signal of the analog data signals;

a plurality of output pads, each being connected to a corresponding source line of the display device;

a plurality of first switches, each being connected between a corresponding one of the output buffers and a corresponding one of the output pads, and being switched on in response to the second output control signal; and a plurality of second switches, each being connected between output terminals of two corresponding ones of the output buffers and switched on in response to a third output control signal, wherein the control signal generation circuit further generates the third output control signal being deactivated in response to the $N^{th}$ falling edge of the first output control signal and then activated in response to the $(N+2)^{th}$ rising edge of the first output control signal.

3. The source driver of claim 2, wherein the control signal generation unit comprises:

a first latch latching the polarity control signal in response to the first output control signal;

a second latch connected to an output terminal of the first latch, and latching a signal from the first latch in response to the first output control signal;

an inverter connected to an output terminal of the second latch;

a NAND gate receiving the first output control signal and a signal from the inverter, and performing a NAND operation on the received signals; and an overlapping prevention circuit receiving a signal from the NAND gate, and generating the second output control signal and the third output control signal which have a predetermined non-overlapped interval and opposite phases except in the non-overlapped interval.

4. The source driver of claim 2, wherein the second output control signal is maintained in an deactivate state and the third output control signal is maintained in an activate state in an active period of the first output control signal.

5. The source driver of claim 1, wherein a phase of the polarity control signal is inverted every two cycles of the first output control signal.

6. A display device comprising:

a controller generating a vertical start signal, output control signals, and digital image data;

a display panel having a plurality of source lines and a plurality of gate lines;

a source driver supplying analog data signals corresponding to the digital image data to the source lines in response to the output control signals and the digital image data;

a first latch latching the polarity control signal in response to a first one of the output control signals;

a second latch latching a signal from an output terminal of the first latch in response to the first output control signal;

an inverter connected to an output terminal of the second latch;

a NAND gate receiving the first output control signal and a signal from the inverter, and performing a NAND operation on the received signals;

an overlapping prevention circuit receiving a signal from the NAND gate, and generating a second output control signal and a third output control signal that have a predetermined non-overlapped interval and opposite phases except in the non-overlapped interval; and a gate driver generating gate line driving signals for sequentially driving the gate lines in response to the vertical start signal, wherein the source driver performs a charge sharing operation for outputs of output buffers buffering the analog data signal during an odd-numbered active period of the first output control signal, and supplies the analog data signals to the source lines in response to an even-numbered rising edge of the first output control signal.

7. The display device of claim 6, wherein the source driver comprises:

a data latch unit receiving and storing the digital image data in response to a horizontal start signal, and outputting the stored digital image data based on a rising edge of the first output control signal, where the horizontal start signal is sequentially shifted in response to a clock signal among the output control signals;

an output unit receiving the digital image data from the data latch unit, and supplying the analog data signals corresponding to the received digital image data to the display panel in response to a polarity control signal and the activated second output control signal among the output control signals; and a control signal generation circuit generating the second output control signal being activated in response to an $N^{th}$ falling edge of the first output control signal and deactivated in response to an $(N+2)^{th}$ rising edge of the first output control signal, in response to the first output control signal and the polarity control signal that controls polarities of the analog data signals supplied to the display panel, where N is an odd number.

8. The display device of claim 7, wherein the output unit comprises:

a digital-to-analog converter generating the analog data signals corresponding to the received digital image data;

a plurality of output buffers buffering the corresponding analog data signals, respectively;

a plurality of output pads connected to the corresponding source lines of the display panel, respectively;

a plurality of first switches, each being connected between a corresponding one of the output buffers and a corresponding one of the output pads, and switched on in response to the second output control signal; and a plurality of second switches, each being connected between output terminals of two corresponding ones of the output buffers, and switched on in response to the third output control signal, wherein the control signal generation circuit further generates the third output control signal being deactivated in response to the $N^{th}$ falling edge of the first output control signal and activated in response to the $(N+2)^{th}$ rising edge of the first output control signal.

9. A method of driving a display device, comprising:

generating output control signals and digital image data;

supplying analog data signals corresponding to the digital image data to a plurality of source lines of a display panel in response to the output control signals and the digital image data; and performing a charge sharing operation for outputs of output buffers buffering the analog data signal during an odd-numbered active period of a first output control signal among the output control signals, and supplying the analog data signals to the source lines at an even-numbered rising edge of the first output control signal, wherein the analog data signals are supplied when a second output control signal among the output control signals is set to a first level at an $N^{th}$ falling edge of the first output control signal, and until the second output control signal is set to a second level lower than the first level at an $(N+2)^{th}$ rising edge of the first output control signal in response to the first output control signal and a polarity signal, where N is an odd number.

* * * * *